US006082347A

United States Patent [19]

Darlington

[11] Patent Number: 6,082,347

[45] Date of Patent: Jul. 4, 2000

[54] SINGLE-CAM COMPOUND ARCHERY BOW

[76] Inventor: Rex F. Darlington, 6828 Maple Acres Dr., Whittemore, Mich. 48770

[21] Appl. No.: 09/239,354

[22] Filed: Jan. 28, 1999

[51] Int. Cl.[7] ..... F41B 5/10

[52] U.S. Cl. ..... 124/25.6; 124/900

[58] Field of Search ..... 124/25.6, 900

[56] References Cited

U.S. PATENT DOCUMENTS

| | | | |
|---|---|---|---|
| 4,519,374 | 5/1985 | Miller . | |
| 4,774,927 | 10/1988 | Larson . | |
| 4,838,236 | 6/1989 | Kudlacek | 124/25.6 |
| 4,926,832 | 5/1990 | Darlington | 124/25.6 |
| 4,926,833 | 5/1990 | Darlington | 124/25.6 |
| 4,967,721 | 11/1990 | Larson | 124/25.6 |
| 4,976,250 | 12/1990 | Jeffrey | 124/25.6 |
| 4,986,250 | 1/1991 | Darlington | 124/25.6 |
| 5,092,309 | 3/1992 | Beaton | 124/25.6 X |
| 5,301,651 | 4/1994 | LaBorde et al. | 124/25.6 |
| 5,368,006 | 11/1994 | McPherson . | |
| 5,433,792 | 7/1995 | Darlington . | |
| 5,505,185 | 4/1996 | Miller | 124/25.6 |
| 5,649,522 | 7/1997 | Troncoso | 124/25.6 |
| 5,678,529 | 10/1997 | Larson | 124/25.6 |
| 5,782,229 | 7/1998 | Evans et al. | 124/25.6 |
| 5,791,322 | 8/1998 | McPherson | 124/25.6 |

FOREIGN PATENT DOCUMENTS 2183305 2/1997 Canada .

OTHER PUBLICATIONS

Mulloney, "One Step Beyond the Compound?" Archery World, Sep. 1976.

"Graham Take–Down Dynabo," Archery World, Jun./Jul. 1980.

Patent application of Larry D. Miller for "Archery Bow Assembly," date and serial number unknown.

Alpine Archery Bow Manual, 1989.

"Instruction Manual—York Thunderbolt DynaBo," York Archery (date unknown).

"M–10 Dynabo Draw Chart," Martin Archery, Inc. (date unknown).

M–10 Cheetah DynaBo Owner's Manual, Martin Archery (date unknown).

*Primary Examiner*—John A. Ricci

*Attorney, Agent, or Firm*—Reising, Ethington, Barnes, Kisselle, Learman & McCulloch, P.C.

[57] ABSTRACT

A single-cam compound archery bow that includes a bow handle having projecting limbs, a control wheel rotatably mounted on an end of one of the limbs remote from the handle, and a power cam rotatably mounted on an end of the other limb also remote from the handle. A power cable segment is anchored at one end to the one limb and at a second end to the power cam at a position to wrap into and unwrap from a power cable groove on the power cam. A bow string cable segment is anchored at the control wheel and at the power cam at positions to wrap into and unwrap from first and second bow string take-up grooves on the control wheel and power cam respectively. A control cable segment is anchored at the control wheel at a position to wrap into and unwrap from a control groove on the control wheel, and is anchored at the power cam. The length of the power cable groove at the power cam and the anchor position of the bow string cable at the control wheel are both adjustable for adjusting draw length of the bow. This is preferably accomplished by means of draw length modules replaceably mounted on the power cam for adjusting draw length in increments associated with each module, and by provision of a plurality of bow string cable anchor points at the control wheel for associated incremental adjustment of the draw length. By adjusting draw length at both the power cam and the control wheel, a flat contour is maintained at the peak of the force/draw curve, and a greater amount of energy is stored in the bow for a given draw length.

21 Claims, 5 Drawing Sheets

SINGLE-CAM COMPOUND ARCHERY BOW

The present invention is directed to compound archery bows, and more particularly to a so-called single-cam compound archery bow having a power let-off cam mounted on the end of only one of the bow limbs.

BACKGROUND AND OBJECTIVES OF THE INVENTION

Compound archery bows typically are of the so-called dual-cam design, originated in U.S. Pat. No. 3,486,495. Bows of this type typically comprise a bow handle having limbs mounted on and extending from opposed ends of the handle. Power let-off cams are rotatably mounted on the free ends of the bow limbs, and are interconnected by one or more cable sections including a draw string section. As the bow draw string is drawn away from the handle, draw force initially increases as the limbs are drawn together and the cams rotate to a power let-off point, and thereafter the leverage increases and the draw force decreases as the cams rotate further but with little additional limb flexure, This so-called compound action allows full bow draw to be maintained at lesser force without fatigue to the archer. A problem inherent in dual-cam cam bows of this type lies in the fact that the cams must be closely matched and synchronized with each other in order to insure straight-line (or substantially straight-line) travel of the nock point on the bow string, and the limbs must be closely balanced and evenly stressed as the string is drawn. Damage to or mismatch of the cams, mismatch or incorrect adjustment of the limbs, or stretching of the cable sections can cause loss of synchronization between the cams and uneven stressing of the limbs, resulting in less than optimum performance of the bow.

In order to overcome the aforementioned deficiencies of dual-cam bows, it has heretofore been proposed to provide a compound bow that has a single power let-off cam disposed at the end of one bow limb, and a control pulley or wheel disposed at the end of the opposing limb over which the bow string is trained. U.S. Pat. No. 5,505,185 discloses such a single-cam compound bow. A control cable cooperates with the power let-off cam and a control groove in the control wheel to maintain the desired relationship or timing between bow string take-up grooves in the control wheel and power cam. In this way, identical or substantially identical incremental bow string cable travel to and from the bow string take-up grooves is obtained, thereby yielding straight-line nock travel as the bow string cable is drawn and released. A power cable extends from the power cam to the opposing bow limb for flexing the bow limbs uniformly as the bow string is drawn, and for cooperating with the power cam to obtain the power let-off action that is characteristic of compound bows.

Although the single-cam compound bow disclosed in the noted patent addresses and overcomes many problems theretofore extant in the art, further improvements remain desirable. In particular, the noted patent does not disclose any means or technique for adjusting draw length of the bow. That is, the bow disclosed in the noted patent obtains straight-line nock travel for a given bow draw length for which the power cam and the control wheel are designed. In order to change or adjust bow string draw length, the power cam and/or the control wheel must be changed to accommodate the new desired draw length while maintaining synchronous timing between the cam and wheel. In a commercial single-cam compound bow of a different design, accommodation is made for changing the bow string cable anchor point at the power let-off cam, and thereby changing the bow string draw length. However, since the cams and wheels are optimized for only a single draw length, changing the bow string anchor point inherently changes the path of nock travel as the bow is drawn and released, and consequently affects accuracy of the bow.

U.S. Pat. No. 08/853,260 discloses a single-cam compound archery bow that includes a bow handle from which bow limbs project, a control wheel rotatably mounted on one end of one limb and a power cam rotatably mounted at an opposing end of the other limb. A power cable segment is anchored at one end to the one limb and at a second end to the power cam at a position to wrap into and unwrap from a power cable groove on the power cam. A bow string cable segment is anchored to the control wheel and to the power cam at positions to wrap into and unwrap from first and second bow string take-up grooves on the control wheel and the power cam respectively. The bow string cable segment has a nock point disposed between the spaced limb ends. A control cable segment is anchored at one end to the control wheel at a position to wrap into and unwrap from a control groove on the control wheel, and is anchored at an opposing end to the power cam. As the bow string cable segment is drawn away from the handle, the bow string cable segment unwraps equally from the control wheel and power cam, wraps the control cable segment into the control groove on the control wheel. Length of the power cable groove on the power cam, and position of the power let-off point on the power cam, are adjustable while maintaining a fixed separation between the power let-off point and the control cable anchor on the power cam, so that the nock point travels in a straight line as the bow string cable section is drawn and released independent of adjusted length of the power cable groove and position of the power let-off point.

Although the single-cam compound bow disclosed in U.S. Pat. No. 08/853,260 addresses the problem of draw length adjustment theretofore extant in the art, further improvements remain desirable. In particular, it has been found that draw length adjustment at the power cam as disclosed in U.S. Pat. No. 08/853,260, by provision of adjustable draw length modules does not optimize contour of the force/draw curve associated with the bow at different draw length adjustments. Specifically, draw length adjustment does not preserve or maintain a flat top on the force/draw curve, which is desirable for optimized "feel" by the archer and maximum storage of bow energy. It is also desirable to improve the manner in which timing between the power cam and control wheel is adjusted for improving straight-line nock travel. It is therefore a general object of the present invention to provide a compound archery bow, particularly a so-called single-cam compound bow, in which bow draw length can be readily adjusted without deleteriously affecting other salutary operating characteristics of the bow. Another object of the present invention is to provide a compound archery bow having marks or indicia on the power cam and control wheel for facilitating adjustment of nock travel and stored energy.

SUMMARY OF THE INVENTION

A single-cam compound archery bow in accordance with one aspect of the present invention includes a bow handle having projecting limbs, a control wheel or pulley rotatably mounted on an end of one of the limbs remote from the handle, and a power cam or pulley rotatably mounted on an end of the other limb also remote from the handle. A power cable segment is anchored at one end to the one limb and at a second end to the power cam at a position to wrap into and unwrap from a power cable groove on the power cam. A bow string cable segment is anchored at the control wheel and at the power cam at positions to wrap into and unwrap from first and second bow string take-up grooves on the control wheel and power cam respectively. A control cable segment is anchored at the control wheel at a position to wrap into and unwrap from a control groove on the control wheel, and is anchored at the power cam. The length of the power cable groove at the power cam and the anchor position of the bow string cable at the control wheel are both adjustable for adjusting draw length of the bow. This is preferably accomplished by means of draw length modules replaceably mounted on the power cam for adjusting draw length in increments associated with each module, and by provision of a plurality of bow string cable anchor points at the control wheel for associated incremental adjustment of the draw length. By adjusting draw length at both the power cam and the control wheel, the total adjustment range is increased, a flat contour is maintained at the peak of the force/draw curve, and a greater amount of energy is stored in the bow for a given draw length.

A compound archery bow in accordance with a second aspect of the invention includes first and second pulleys mounted for rotation at opposed ends of limbs on a bow handle. Bow cables are trained around and extent between the first and second pulleys, and are anchored to at least one of the limbs for drawing the bow. Timing indicia are provided on both of the pulleys for selective registry with the bow cables as the pulleys are rotated. Each pulley includes facility for selectively adjusting length of the bow cables and thereby bringing the indicia on the pulleys into registry with the bow cables. In this way, position and travel of a nock point on the bow cables are adjusted by registry of the bow cables with the indicia on the pulleys. This aspect of the invention is useful in conjunction with both single-cam and dual-cam bows.

In a single-cam compound bow preferred embodiment of this second aspect of the invention, the indicia on the cams comprises timing marks on a power cam for selective registry with the power cable segment that extends from the power cam to the opposing bow limb, and timing marks on the control wheel for selective registry with either the control cable or the bow string cable as the cable leaves the control wheel. Registry of the timing marks with the power cable segment at the power cam is obtained by selectively adjusting length of the power cable segment, while registry of the timing marks with the control cable or bow string segment at the control wheel is obtained by adjusting length of the control cable segment.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
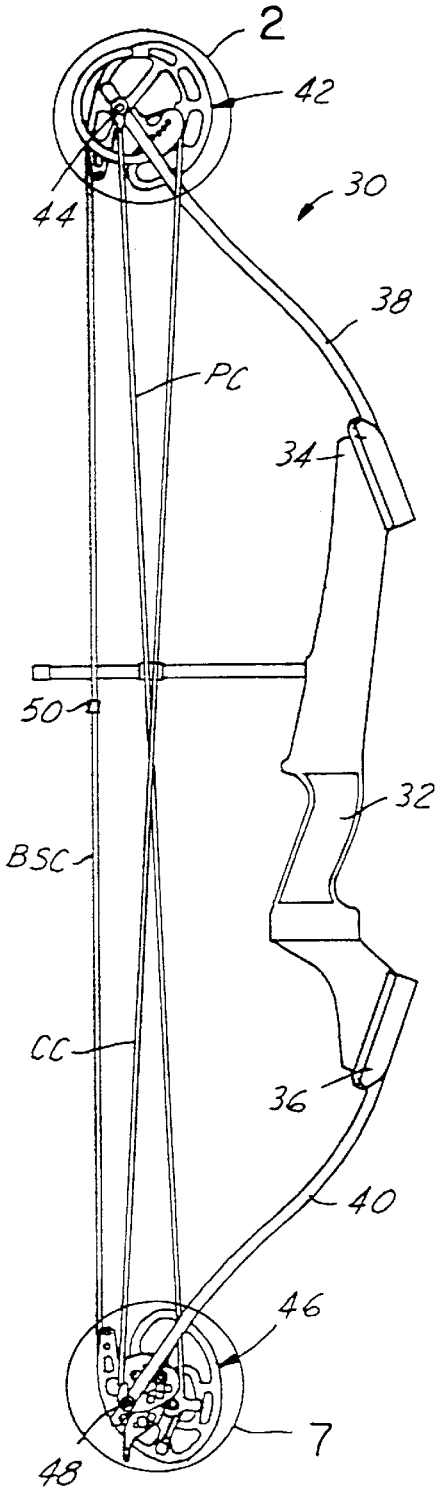
FIG. 1 is a side elevational view of a single-cam compound archery bow in accordance with one presently preferred embodiment of the invention.
Figure 2:
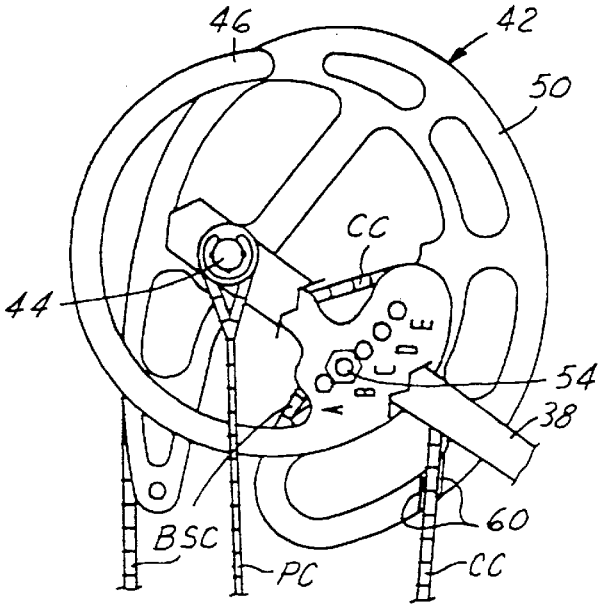
FIG. 2 is a fragmentary elevational view on an enlarged scale of the portion of FIG. 1 within circle 2, featuring a control wheel in accordance with one presently preferred embodiment of the invention.
Figure 3:
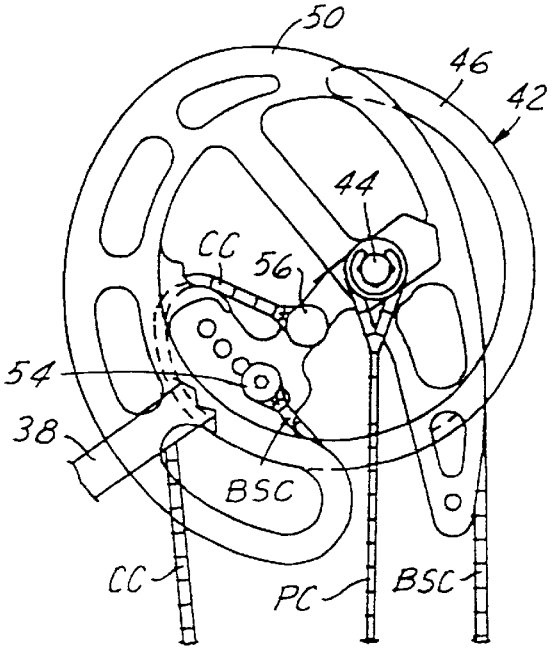
FIG. 3 is a fragmentary elevational view of that portion of the bow illustrated in FIG. 2 but viewed from the opposite side.
Figure 6:
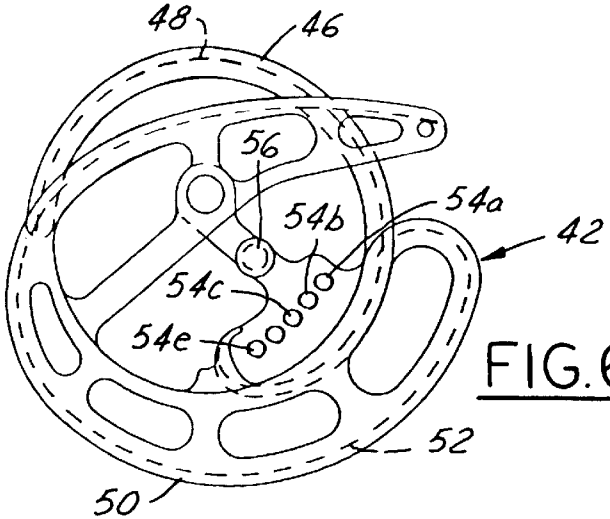
FIG. 6 is an elevational view of the control wheel illustrated in FIG. 4 but viewed from the opposite side.
Figure 5:
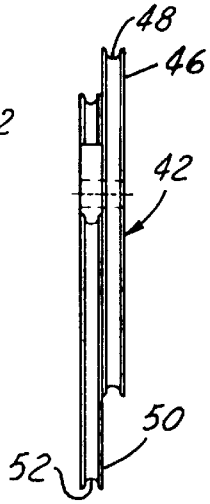
FIG. 5 is an end elevational view of the control wheel illustrated in FIG. 4.
Figure 4:
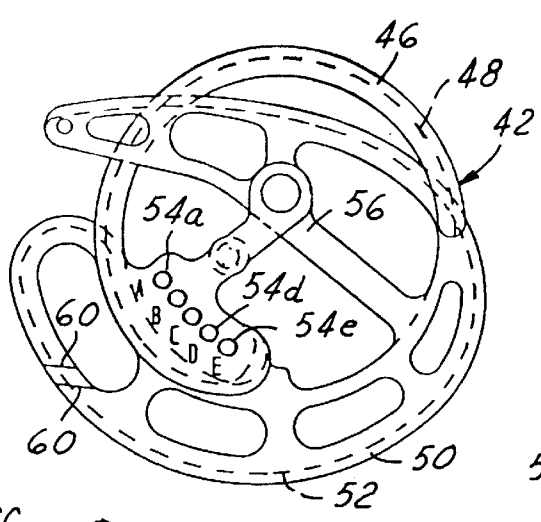
FIG. 4 is a side elevational view of the control wheel illustrated in FIGS. 1–3.

FIG. 1 illustrates a single-cam compound archery bow 30 in accordance with a presently preferred embodiment of the invention as comprising a handle 32 of cast magnesium or other rigid unitary construction having spaced ends 34, 36 with flat limb-mounting surfaces at each end. A pair of flexible limbs 38, 40 of fiber-reinforced resin or other suitable resilient construction are mounted on handle ends 34, 36 respectively, and project away from handle 32. A control wheel 42 is rotatably mounted on an axle 44 that extends laterally across the free end of bow limb 38, such that control wheel 42 is rotatably mounted within an open notch at the free end of limb 38. Likewise, a power cam 46 is rotatably mounted on an axle 48 that extends laterally across the free end of limb 40, such that power cam 46 is rotatably mounted within a notch at the free end of limb 40. A power cable PC has a split end that is anchored to limb 38 at axle 44, preferably although not necessarily on both sides of control wheel 42. Power cable PC extends across bow 30 to power cam 46, at which power cable PC is anchored. A control cable CC is anchored at one end to control wheel 42, and at an opposing end to power cam 46. Likewise, a bow string cable BSC is anchored at opposing ends to control wheel 42 and power cam 46. A nock 50 is carried by bow string cable BSC between control wheel 42 and power cam 46.

Referring in detail to FIGS. 2–6, control wheel 42 comprises a one-piece frame that mounts a bearing through which axle 44 extends. A part-circular track 46 surrounds axle 44, within which a radially outwardly facing peripheral control groove 48 is formed. That is, control or timing groove 48 is of generally circular geometry off-center with respect to axle 44 around which control wheel 42 rotates. A non-circular second track 50 extends around control wheel 42 laterally offset from track 46, within which a radially outwardly facing bow string take-up groove 52 is formed. Bow string take-up groove 52 is thus of non-circular geometry in the embodiment of the invention illustrated in the drawings. Both grooves 48, 52 are eccentric to the axis of the axle. Control wheel 42 is preferably of one-piece monolithic construction. At the rest position of the bow (FIGS. 1–3) bow string cable BSC is trained entirely around bow string take-up groove 52 to an anchor 54 carried by control wheel 42. Control cable CC is trained in the opposite direction around control groove 48, and thence to an anchor 56 on control wheel 42.

In accordance with one aspect of the present invention, bow string anchor 54 comprises a pulley and a flat head screw that may be selectively mounted at any one of a plurality of positions 54*a*–54*e* for incrementally adjusting bow draw length as will be described. Each position 54*a*–54*e* is defined by a corresponding threaded opening in the base of control wheel 42 within the periphery of the bow string and control grooves. In the particular embodiment shown, openings 54*a*–54*e* are disposed in an arc around control cable anchor 56, which is preferably formed monolithically with control wheel 42 or otherwise fixedly secured thereto. Thus, the bow string cable may be selectively anchored at differing incremental positions to the control wheel, which are marked "A," "B," "C," "D" and "E" or with other suitable identifying indicia for facilitating adjustment. In accordance with another aspect of the present invention, a pair of timing marks 60 or other suitable indicia are formed or otherwise permanently secured on bow string track 50 at a position for aligned registry with control cable CC as the control cable tangentially leaves control cable groove 48. These timing marks 60 cooperate with similar timing marks on the power cam to facilitate timing adjustment of the bow, as will be described.

Figure 8:
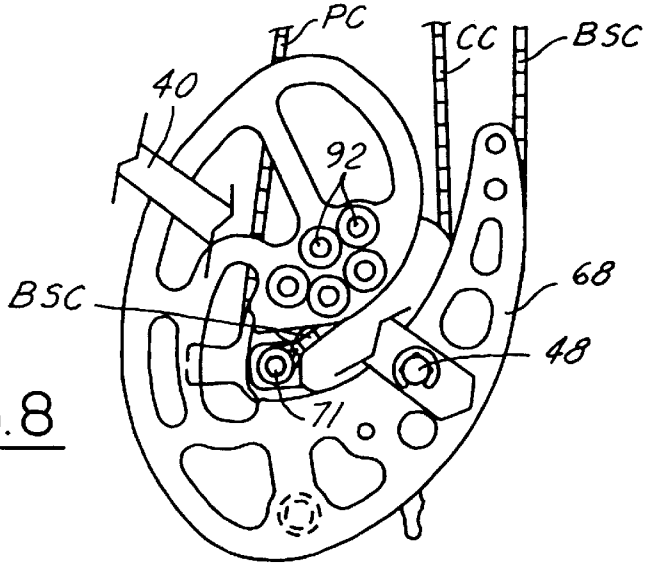
FIG. 8 is a fragmentary elevational view of the portion of the bow illustrated in FIG. 7 but viewed from the opposite side.
Figure 7:
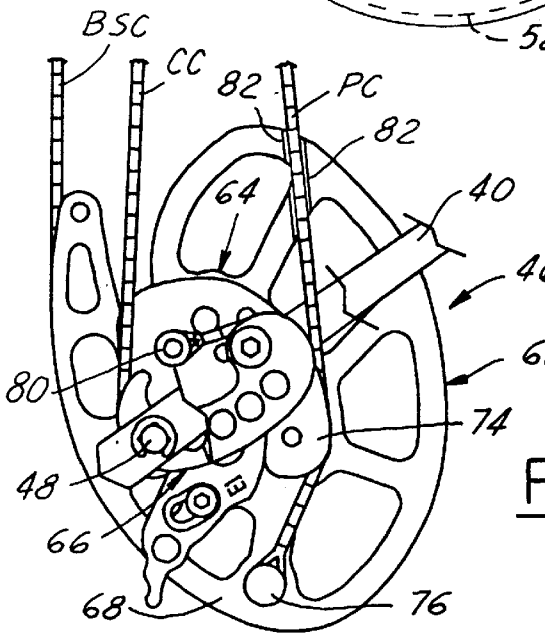
FIG. 7 is a fragmentary elevational view on an enlarged scale of the portion of FIG. 1 within the circle 7, featuring the power cam in accordance with a presently preferred embodiment of the invention.
Figure 11:
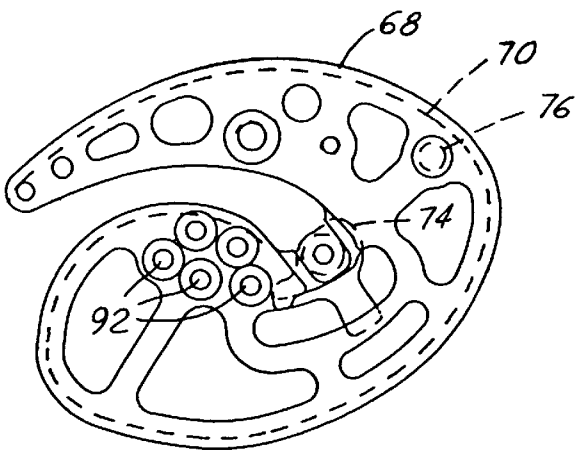
FIG. 11 is a side elevational view of the power cam base illustrated in FIG. 9 but viewed from the opposite side.
Figure 10:
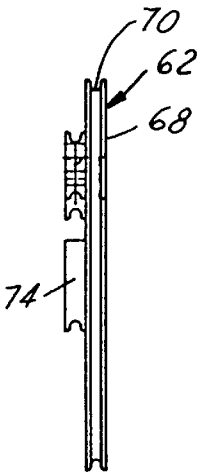
FIG. 10 is an end elevational view of the power cam base illustrated in FIG. 9.
Figure 9:
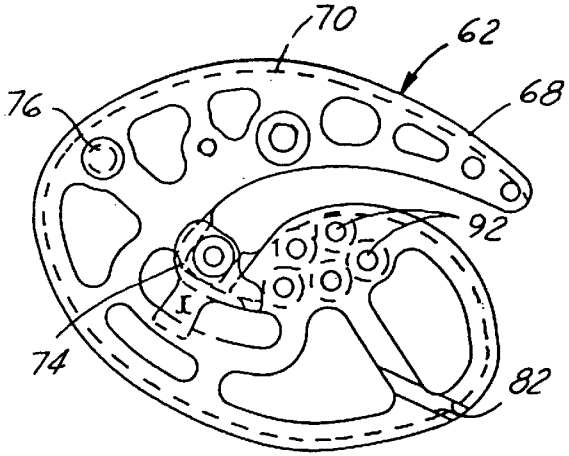
FIG. 9 is a side elevational view of the power cam base in the power cam of FIGS. 7–8.

FIGS. 7 and 8 show the assembly of power cam 46, while FIGS. 9–14 show components of the power cam assembly. In general (with the exception of the timing marks to be described), power cam 46 is of constriction generally similar to that disclosed in above-noted U.S. Pat. No. 08/853,260, which is incorporated herein by reference for purposes of background. Power cam 46 includes a cam base 62 upon which a draw length adjustment module 64 and a control arm 66 are mounted. Cam base 62 has bearings for rotatable mounting on axle 48. A track 68 extends around the periphery of cam base 62, and forms a radially outwardly extending bow string take-up groove 70. Bow string cable BSC anchors at 71 adjacent to groove 70. Draw length adjustment module 64 is rotatably mounted on cam base 62, and has a radially outwardly facing track 72 that forms part of the power cable take-up groove. A second portion of the power cable take-up groove is formed by a guide 74 fixedly secured to cam base 62 and positioned so that the cable groove segments align with each other. A power cable anchor 76 is formed with or otherwise fixedly secured to cam base 62 in tangential alignment with the power cable groove segments on module 64 and guide 74. Control arm 66 is mounted on cam base 62 overlying module 64. The periphery of control arm 66 forms a control cable let-out groove 78. An anchor 80 is secured to module 64 for anchoring control cable CC.

Figure 12C:
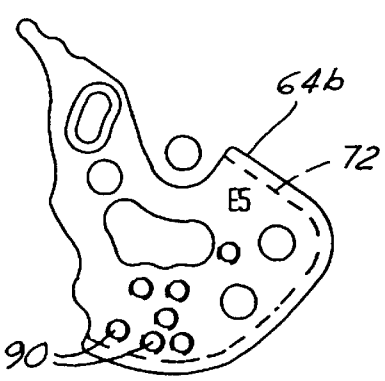
FIGS. 12A, 12B and 12C are elevational views of alternative draw length modules in the power cam assembly illustrated in FIGS. 7–8.
Figure 12B:
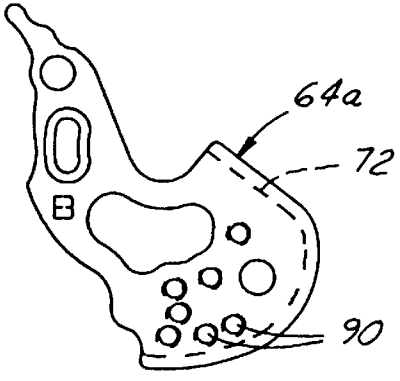
Figure 12A:
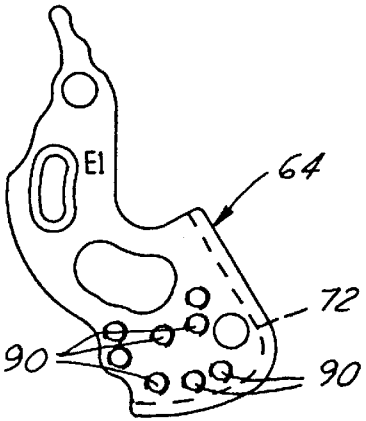
Figure 13:
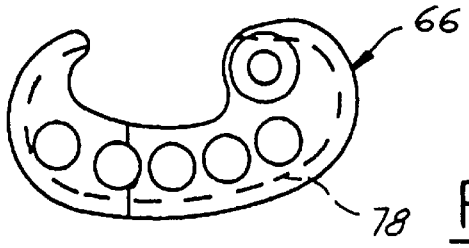
FIGS. 13 and 14 are side and end elevational views of the control arm in the power cam assembly illustrated in FIGS. 7–8.
Figure 14:
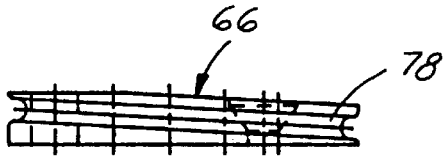

In accordance with one aspect of the present invention, timing mark indicia 82 are formed on cam base 62 at a position for tangential alignment with power cable take-up groove 72. These timing marks cooperate with the power cable and the timing marks on the control wheel for adjusting timing of the respective wheels, as will be described. These timing marks 82 (and timing marks 60 on control wheel 42) preferably comprise parallel marks spaced from each other to embrace the associated cable when in registered alignment. These marks may be cast into the associated elements as formed, or formed in subsequent machining operations. In the embodiment of the invention illustrated in FIGS. 1–15, draw length adjustment modules 64 are both adjustably and replaceably mounted on cam base 62. Thus, FIGS. 12A, 12B, 12C illustrate three draw length modules 64, 64*a* and 64*b* of three differing draw lengths, such as 27 inches, 29 inches and 31 inches respectively. Other draw length modules, such as for intermediate lengths of 28 inches and 30 inches, may also be provided with the bow assembly or made available in the aftermarket.

For tuning the bow 30, the bow should be placed in a suitable tuning press. Power cable PC is first aligned between timing marks 82 on power cam base 62. This may be accomplished by removing the power cable from its anchor 76, and either twisting or untwisting the power cable until it lines up correctly. Twisting or untwisting the power cable has the effect of shortening or lengthening the power cable. Control wheel 42 is then adjusted for controlling nock travel. In the embodiment of FIGS. 1–15, control cable CC is lengthened or shortened until the control cable is in registered alignment between tuning marks 60 on the control wheel. (Draw length module 64 must be in the same position as used to check the timing of the power cam as discussed above). Control cable CC is removed from its anchor 56 and selectively twisted or untwisted for shortening or lengthening the length of the control cable. When power cable PC is in aligned registry between timing marks 82 on power cam 46 and control cable CC is in aligned registry between timing marks 60 on control wheel 42, the power cam and control wheel are properly timed with respect to each other, and draw length may then be adjusted.

Figure 15:
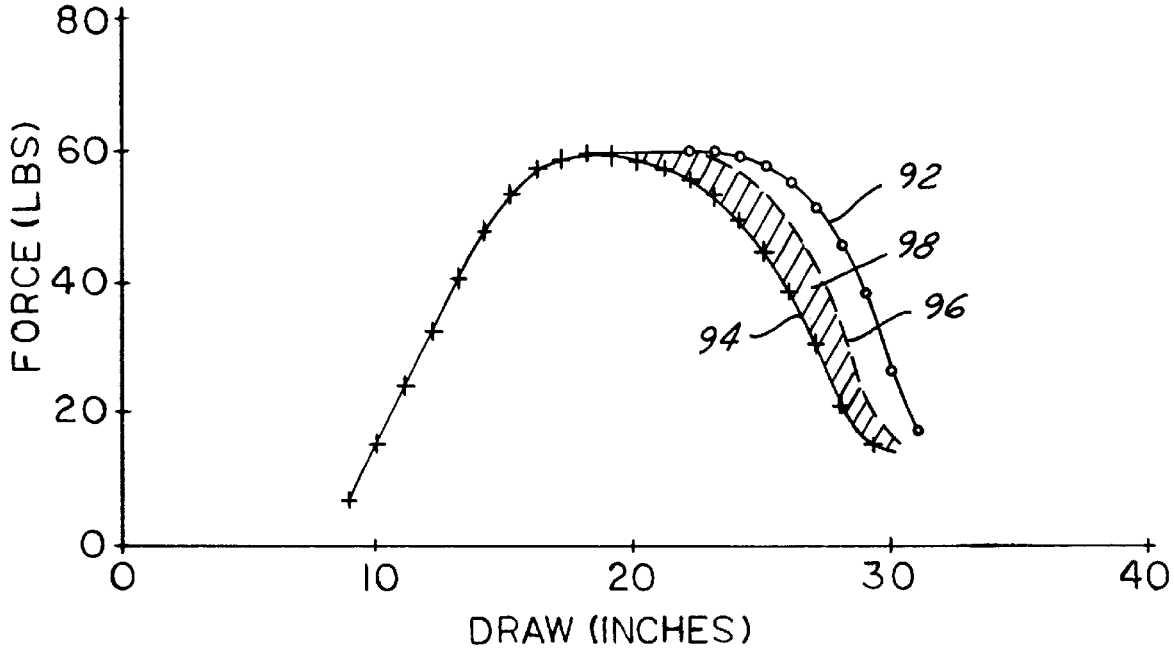
FIG. 15 is a graph illustrating bow force versus draw length in accordance with the embodiment of FIGS. 1–14.

In the embodiment of the invention illustrated in FIGS. 1–15, draw length adjustment at power cam 46 is effected by draw length modules that are both replaceable and adjustable on the power cam base. For a given module 64 (or 64*a* or 64*b*), draw length is increased by increasing the separation between that portion of power cable take-up groove track 72 on the draw length module and that portion of the power cable take-up groove on guide 74. This selective adjustment of a draw length module on the cam base is effected by loosening the module on the cam base, and then rotating the module on the cam base while internally threaded openings 90 in the module selectively registered with openings 92 in the cam base. Draw length is thus incrementally adjusted at the power cam. The use of different modules 64, 64*a*, 64*b* increases the range of adjustment. Referring to FIG. 15, curve 92 illustrates a force/draw curve as it may be supplied by the factory. Curve 94 illustrates the corresponding force/draw curve as draw length is decreased by a one-inch increment through adjustment of the draw length module at the power cam. Note that there is a decrease in the flat plateau at the top of the force/draw curve. Provision of supplementary draw length adjustment at the control wheel in accordance with an aspect of the present invention allows not only for fine-tuning the draw length, but also for modifying the force/draw curve to assume the curve 96. There is an increase in the flat portion of the force/draw curve, as well as an increase in overall stored energy, represented by the cross-hatched area 98. An adjustable draw length module 64 may provide a total of 1½ inches of adjustment in ⅜ inch increments for example, while the control wheel may provide an additional ¾ inches of draw length adjustment in approximately 3/16 inch increments. This adjustment helps maintain optimum stored energy. For example, a 2-position positive adjustment of draw length module position would increase draw length ¾ of an inch, while a 1-position negative adjustment at the control wheel would decrease draw length approximately 3/16 of an inch, for a net increase of 9/16 inch.

Figure 16:
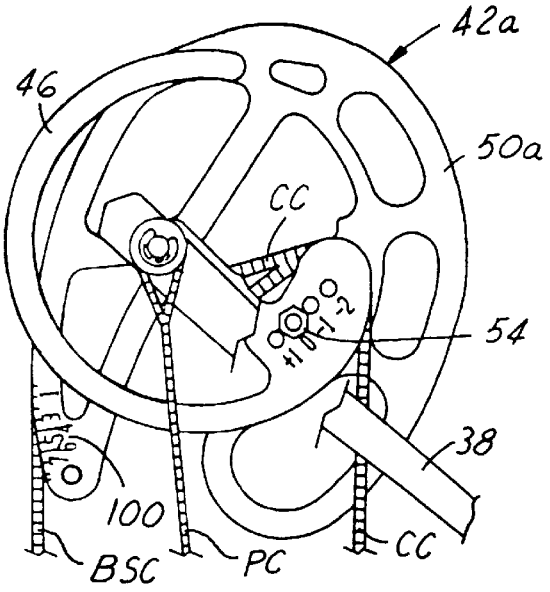
FIG. 16 is a side elevational view similar to that of FIG. 2 but illustrating a control wheel in accordance with a modified embodiment of the invention.
Figure 17:
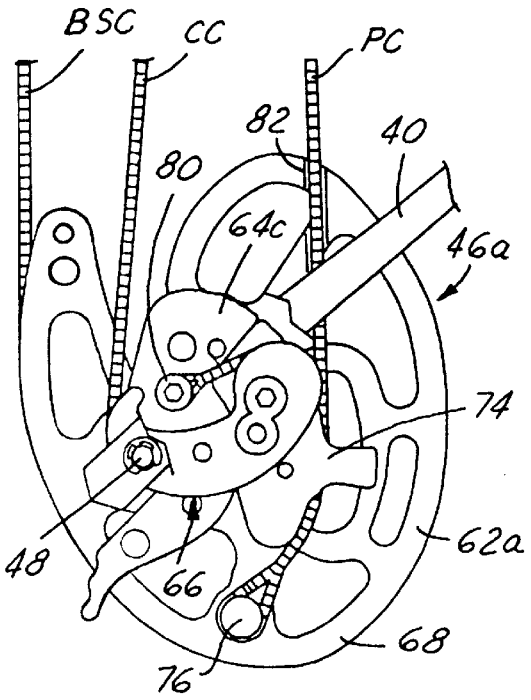
FIG. 17 is a side elevational view similar to that of FIG. 7 but illustrating a power cam in accordance with the modified embodiment of the invention.

FIGS. 16 and 17 illustrate a modified control wheel 42*a*, and a modified power cam 46*a*. Control wheel 42*a* is similar to control wheel 42, except that the parallel timing marks on track 50 (FIG. 4) are replaced by an array 100 of vernier-type timing marks at the edge of bow string track 50*a*. Likewise, power cam 46*a* is basically similar to power cam 46 previously discussed, except that draw length adjustment module 64*c* is replaceably but not adjustably mounted on cam base 62*a*. Timing adjustment is obtained by selectively lengthening or shortening power cable PC until the power cable is in aligned registry between marks on cam base 62*a* as previously discussed, and by selectively lengthening and shortening control cable CC until bow string cable BSC leaves track at the desired tangential position according to vernier 100. For example, FIG. 16 illustrates bow string cable BSC leaving bow string track at vernier position "8." Draw length adjustments are made at power cam 46*a* by selective replacement of module 64*c*, and at control wheel 42*a* by selectively positioning the anchor of bow string cable BSC as previously discussed.

Figure 18:
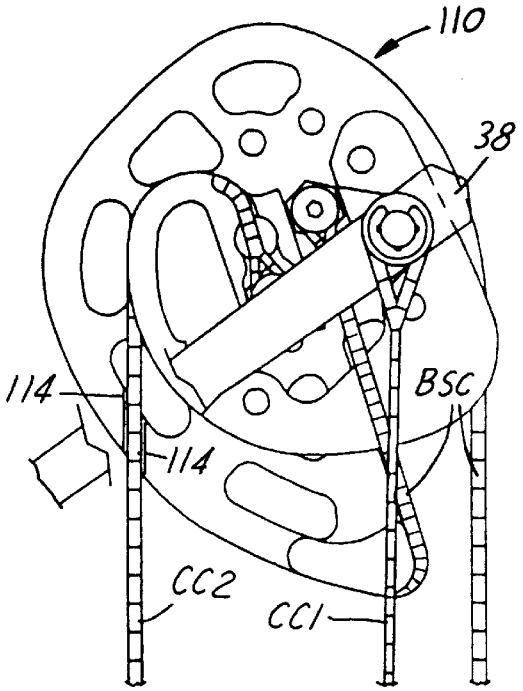
FIGS. 18 and 19 are views similar to those of FIGS. 3 and 8 showing a dual-cam bow in accordance with an aspect of the invention.
Figure 19:
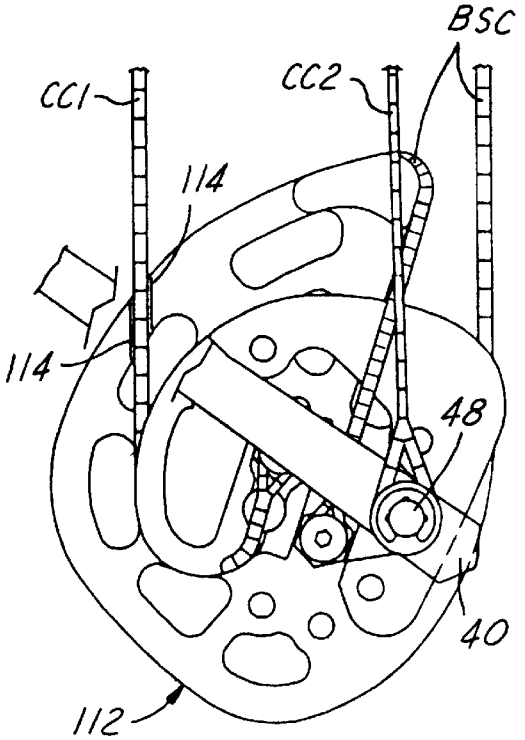

FIGS. 18 and 19 illustrate a dual-cam bow provided with power cams 110, 112 at the ends of limbs 38, 40. A pair of control cables CC1, CC2 connect each limb end to a take-up groove on the opposing cam. A bow string cable BSC has opposed ends in let-out grooves of the opposing cams. To this extent, cams 110, 112 are conventional and mirror images of each other. A pair of timing marks or indicia 114 are provided on the bow string track of each cam at a position for aligned registry with control cable CC1 or CC2 as it passes from the cam. Thus, timing marks 114 on cam 110 are parallel to and spaced from each other for aligned registry with cable CC2 (FIG. 18), and marks 114 on cam 112 are parallel to and spaced from each other for aligned registry with cable CC1 (FIG. 19). Timing is adjusted by shortening or lengthening (twisting or untwisting) cables CC1 and CC2.

What is claimed is:

1. A single-cam compound bow that comprises:

a bow handle having projecting limbs, a control wheel rotatably mounted on an end of one of said limbs remote from said handle, said control wheel having a control groove and a first bow string take-up groove, a power cam rotatably mounted on an end of the other of said limbs remote from said handle, said power cam including a second bow string take-up groove and a power cable groove, bow cable means including a power cable segment anchored at one end to said one limb and at a second end to said power cam at a position to wrap into and unwrap from said power cable groove, a bow string cable segment anchored at said control wheel and said power cam at positions to wrap into and unwrap from said first and second bow string take-up grooves respectively, said bow string cable segment having a nock point disposed between said limbs ends, and a control cable segment anchored at said control wheel at a position to wrap into and unwrap from said control groove and anchored at said power cam, such that draw of said bow string cable segment away from said handle unwraps said bow string cable segment from said control wheel and said power cam, wraps said power cable segment into said power cable groove so as to draw said limb ends together, and wraps said control cable segment into said control groove on said control wheel, and means for adjusting effective length of said bow string cable segment, and thereby adjusting travel of said nock point, comprising timing marks on said control wheel and said power cam, means on said control wheel for adjusting length of said control cable segment until said timing marks on said control wheel register with one of said control cable segment and said bow string cable segment, and means on said power cam for adjusting length of said power cable segment until said timing marks on said power cam register with said power cable segment.

2. The bow set forth in claim 1 wherein said timing marks on said control wheel are positioned for registry with said control cable segment.

3. The bow set forth in claim 1 wherein said timing marks on said control wheel are positioned for registry with said bow string cable segment.

4. The bow set forth in claim 1 wherein said means on said power cam comprises an anchor for said power cable segment.

5. The bow set forth in claim 1 wherein said means on said control wheel comprises an anchor for said control cable segment.

6. The bow set forth in claim 5 wherein said bow string cable segment has an anchor at said control wheel that is selectively positionable on said control wheel for adjusting draw length of said bow.

7. The bow set forth in claim 6 further comprising means on said power cam for adjusting length of said power cable groove.

8. The bow set forth in claim 7 wherein said groove length-adjusting means comprises means for selectively mounting differing draw length modules on said power cam having differing power cable groove lengths.

9. The bow set forth in claim 8 wherein said groove length-adjusting means further comprises means for adjustably positioning each said module on said power cam.

10. A compound archery bow that comprises:

a bow handle having protecting limbs, first pulley means including means mounting said fist pulley means for rotation about a first axis at an end of one of said limbs, second pulley means including means mounting said second pulley means for rotation about a second axis at an end of the other of said limbs, bow cable means trained around and extending between said first and second pulley means and anchored to at least one of said limbs for drawing said bow, timing indicia on both of said pulley means for selective registry with said bow cable means as said pulley means are rotated, and means on each of said pulley means for selectively adjusting length of said bow cable means and thereby bring said indicia on said pulley into registry with said bow cable means.

11. The bow set forth in claim 10 wherein said bow cable means includes a bow string cable segment having a nock point disposed between said pulley means, and wherein travel of said nock point are adjusted by registry of said bow cable means with said indicia.

12. The bow set forth in claim 10 wherein said bow comprises a single-cam bow, with said first pulley comprising a control wheel and said second pulley comprising a power cam.

13. The bow set forth in claim 10 wherein said bow comprises a dual-cam bow, with said first and second pulleys comprising respective power cams.

14. A single-cam compound bow that comprises:

a bow handle having projecting limbs, a control wheel rotatably mounted on an end of one of said limbs remote from said handle, said control wheel having a control groove and a first bow string take-up groove, a power cam rotatably mounted on an end of the other of said limbs remote from said handle, said power cam including a second bow string take-up groove and a power cable groove, bow cable means including a power cable segment anchored at one end to said one limb and at a second end to said power cam at a position to wrap into and unwrap from said power cable groove, a bow string cable segment anchored at said control wheel and said power cam at positions to wrap into and unwrap from said first and second bow string take-up grooves respectively, said bow string cable segment having a nock point disposed between said limbs ends, and a control cable segment anchored at said control wheel at a position to wrap into and unwrap from said control groove and anchored at said power cam, such that draw of said bow string cable segment away from said handle unwraps said bow string cable segment from said control wheel and said power cam, wraps said power cable segment into said power cable groove so as to draw said limb ends together, and wraps said control cable segment into said control groove on said control wheel, and means on both said power cam and said control wheel for adjusting draw length of said bow, said means on said control wheel for adjusting draw length of said bow comprising a plurality of openings in said control wheel, a pulley for receiving a looped end of said bowstring cable segment, and a screw selectively receivable in said openings for anchoring said pulley and said looped end of said bowstring cable segment to said control wheel at said openings corresponding to incrementally differing draw lengths.

15. The bow set forth in claim 14 further comprising means on said power cam for adjusting length of said power cable groove.

16. The bow set forth in claim 15 wherein said groove length-adjusting means comprises means for selectively mounting differing draw length modules on said power cam having differing power cable groove lengths.

17. The bow set forth in claim 16 wherein said groove length-adjusting means further comprising means for adjustably postioning each said module on said power cam.

18. The bow set forth in claim 18 further comprising means for adjusting effective length of said bow string cable segment, and thereby adjusting travel of said nock point, comprising timing marks on said control wheel and said power cam, means on said control wheel for adjusting length of said control cable segment until said timing marks on said control wheel register with one of said control cable segment and said bow string cable segment, and means on said power cam for adjusting length of said power cable segment until said timing marks on said power cam register with said power cable segment.

19. A single-cam compound bow that comprises:

a bow handle having projecting limbs, a control wheel rotatably mounted on an end of one of said limbs remote from said handle, said control wheel having a control groove and a first bow string take-up groove, a power cam rotatably mounted on an end of the other of said limbs remote from said handle, said power cam including a second bow string take-up groove and a power cable groove, bow cable means including a power cable segment anchored at one end to said one limb and at a second end to said power cam at a position to wrap into and unwrap from said power cable groove, a bow string cable segment anchored at said control wheel and said power cam at positions to wrap into and unwrap from said first and second bow string take-up grooves respectively, said bow string cable segment having a nock point disposed between said limbs ends, and a control cable segment anchored at said control wheel at a position to wrap into and unwrap from said control groove and anchored at said power cam, such that draw of said bow string cable segment away from said handle unwraps said bow string cable segment from said control wheel and said power cam, wraps said power cable segment into said power cable groove so as to draw said limb ends together, and wraps said control cable segment into said control groove on said control wheel, means on both said power cam and said control wheel for adjusting draw length of said bow, comprising means for selectively anchoring said bow string cable segment at differing positions corresponding to incrementally differing draw lengths, and means for adjusting effective length of said bow string cable segment, and thereby adjusting position and travel of said nock point, comprising timing marks on said control wheel and said power cam, means or said control wheel for adjusting length of said control cable segment until said timing marks on said control wheel register with one of said control cable segment and said bow string cable segment, and means on said power cam for adjusting length of said power cable segment until said timing marks on said power cam register with said power cable segment.

20. The bow set forth in claim 19 wherein said timing marks on said control wheel are positioned for registry with said control cable segment.

21. The bow set forth in claim 19 wherein said timing marks on said control wheel are positioned for registry with said bow string cable segment.

* * * * *